US010210989B2

(12) United States Patent
Sobashima et al.

(10) Patent No.: US 10,210,989 B2
(45) Date of Patent: Feb. 19, 2019

(54) REACTOR

(71) Applicant: TOKIN CORPORATION, Sendai-shi, Miyagi (JP)

(72) Inventors: Takashi Sobashima, Sendai (JP); Takashi Yanbe, Sendai (JP); Masahiro Kondo, Sendai (JP); Hirofumi Sato, Sendai (JP)

(73) Assignee: TOKIN CORPORATION, Sendai-Shi, Miyagi (JP)

( * ) Notice: Subject to any disclaimer, the term of this patent is extended or adjusted under 35 U.S.C. 154(b) by 0 days.

(21) Appl. No.: 15/622,243

(22) Filed: Jun. 14, 2017

(65) Prior Publication Data

US 2017/0372830 A1 Dec. 28, 2017

(30) Foreign Application Priority Data

Jun. 28, 2016 (JP) ..... 2016-128033

(51) Int. Cl.

*H01F 27/32* (2006.01)
*H01F 27/255* (2006.01)
*H01F 27/28* (2006.01)

(52) U.S. Cl.

CPC ..... *H01F 27/255* (2013.01); *H01F 27/2823* (2013.01); *H01F 27/32* (2013.01); *H01F 27/324* (2013.01)

(58) Field of Classification Search

None

See application file for complete search history.

(56) References Cited

FOREIGN PATENT DOCUMENTS

| | | | | |
|---|---|---|---|---|
| JP | 2006004957 A | | 1/2006 | |
| JP | 2010232421 A | * | 10/2010 | ..... H01F 27/255 |
| JP | 2010238920 A | * | 10/2010 | |
| JP | 2012089899 A | | 5/2012 | |

* cited by examiner

*Primary Examiner* — Tuyen Nguyen

(74) *Attorney, Agent, or Firm* — Holtz, Holtz & Volek PC

(57) ABSTRACT

A reactor comprises a coil member and a core member. The coil member comprises an insulation-coated conductive wire and an insulation coating. The insulation-coated conductive wire is wound and coated, at least in part, with the insulation coating. The core member comprises a first member and a second member. The first member has a relative permeability higher than another relative permeability of the second member. The second member includes a composite magnet, and the relative permeability of the second member is between 1 and 30 (both inclusive). The composite magnet is formed of a hardened binder and magnetic particles dispersed in the binder. The composite magnet has an elastic modulus that is one hundred times or more than another elastic modulus of the insulation coating.

4 Claims, 7 Drawing Sheets

REACTOR

CROSS REFERENCE TO RELATED APPLICATIONS

This application is based on and claims priority under 35 U.S.C. § 119 to Japanese Patent Application No. JP2016-128033 filed Jun. 28, 2016, the content of which is incorporated herein in its entirety by reference.

BACKGROUND OF THE INVENTION:

This invention relates to a reactor comprising a core member and a coil member which has a coil body embedded in the core member.

For example, a reactor comprising a core member and a coil member is disclosed in each of JP 2012-89899A (Patent Document 1) and JP 2006-4957A (Patent Document 2), the contents of which are incorporated herein by reference.

The core member of the reactor of Patent Document 1 includes two types of members which have relative permeabilities different from each other.

Patent Document 2 discloses a coil component which is usable as a reactor. The coil component of Patent Document 2 comprises a magnetic core (core member) and a coil member having a coil body. The magnetic core is a composite magnet which is made by hardening a mixture of magnetic particles and a binder made of resin. The coil body of the coil member is embedded in the magnetic core.

The composite magnet of Patent Document 2 has a relative permeability lower than that of a dust core. The composite magnet of Patent Document 2 can be used in the reactor of Patent Document 1. For example, the two types of members of the core member of Patent Document 1 may be the composite magnet and the dust core.

The aforementioned reactor that comprises the composite magnet and the dust core may be installed and used in a vehicle. When used in a vehicle, the reactor is exposed to an environment in which the temperature changes largely. Under the environment of large temperature change, thermal expansion of the coil member might apply a large stress against the core member to damage the core member.

SUMMARY OF THE INVENTION

It is therefore an object of the present invention to provide a reactor which comprises a core member formed of a low relative permeability member including a composite magnet and a high relative permeability member such as a dust core and which is formed so as to prevent the core member from being damaged even when used under an environment of large temperature change.

An aspect of the present invention provides a reactor comprising a coil member and a core member. The coil member comprises an insulation-coated conductive wire and an insulation coating. The insulation-coated conductive wire is wound and coated, at least in part, with the insulation coating. The core member comprises a first member and a second member. The first member has a relative permeability higher than another relative permeability of the second member. The second member includes a composite magnet, and the relative permeability of the second member is between 1 and 30 (both inclusive). The composite magnet is formed of a hardened binder and magnetic particles dispersed in the binder. The composite magnet has an elastic modulus that is one hundred times or more than another elastic modulus of the insulation coating.

According to an aspect of the present invention, the elastic modulus of the composite magnet is one hundred times or more than the elastic modulus of the insulation coating. In other words, the insulation coating is made of material which is so soft that the insulation coating has the elastic modulus of one percent or less than the elastic modulus of the composite magnet. Even if the insulation-coated conductive wire of the coil member is deformed because of temperature change, the insulation coating is deformed so as to absorb the deformation of the insulation-coated conductive wire. This deformation of the insulation coating reduces the deformation of the whole of the coil member including the insulation coating. Therefore, a stress applied to the core member from the coil member can be reduced, so that the core member can be prevented from being damaged.

An appreciation of the objectives of the present invention and a more complete understanding of its structure may be had by studying the following description of the preferred embodiment and by referring to the accompanying drawings.

Figure 1:
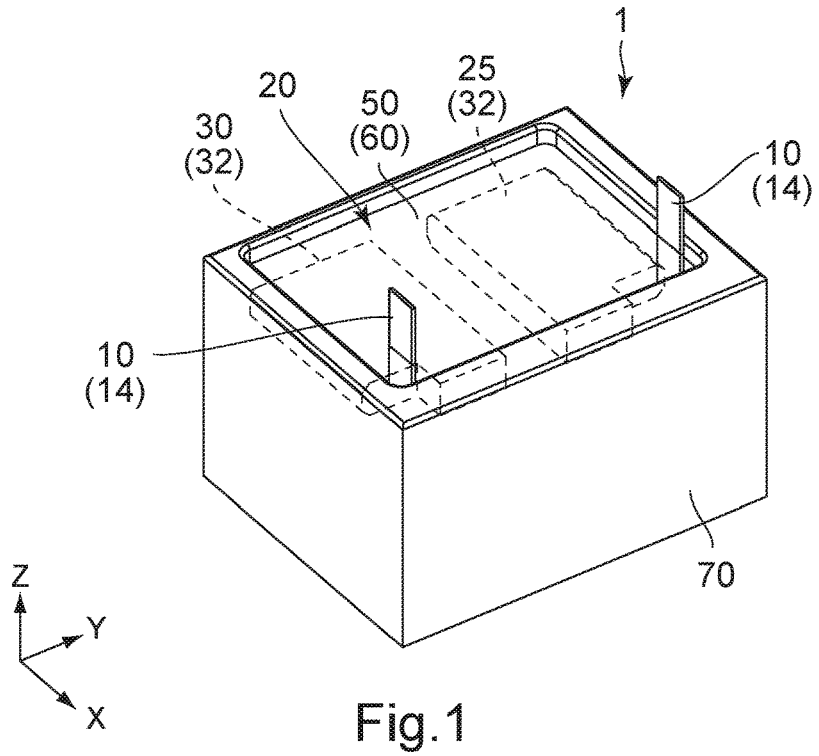
FIG. 1 is a perspective view showing a reactor according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
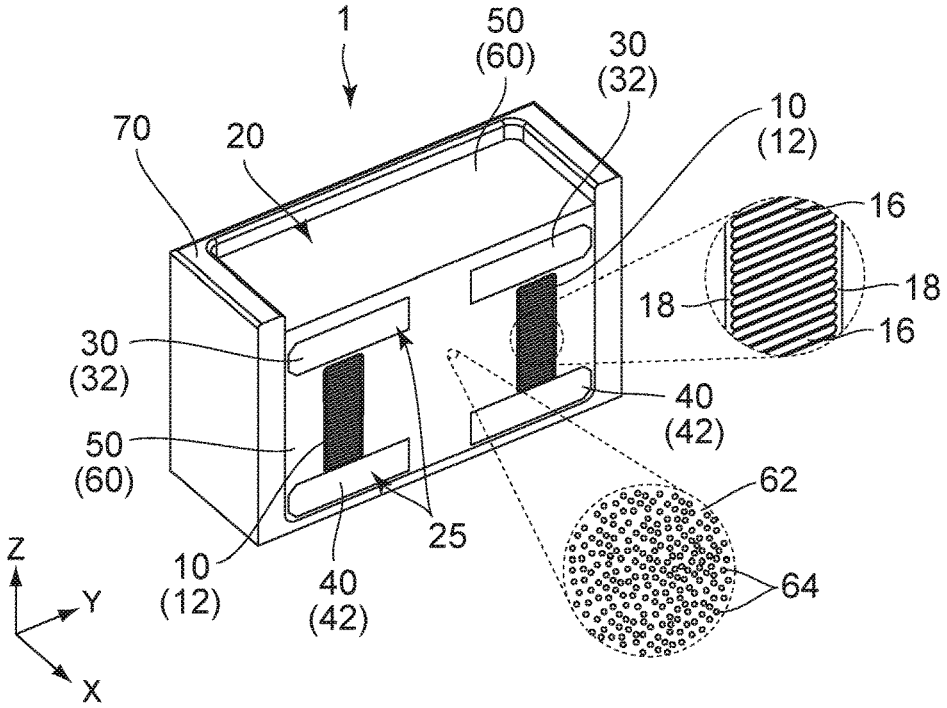
FIG. 2 is a partially cut-away, perspective view showing the reactor of FIG. 1.
Figure 3:
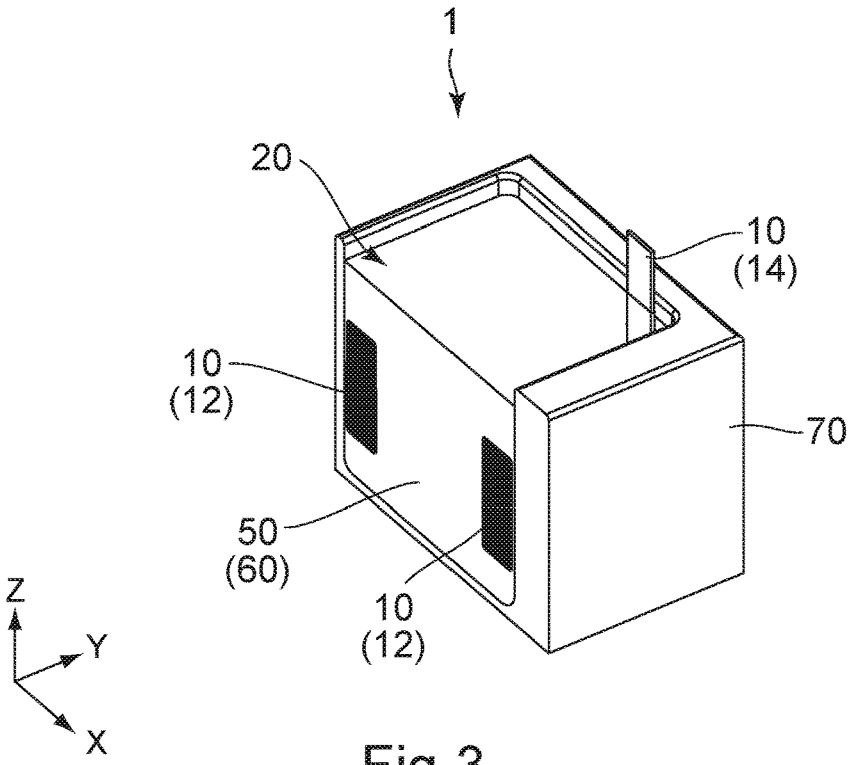
FIG. 3 is another partially cut-away, perspective view showing the reactor of FIG. 1.

As shown in FIGS. 1 to 3, a reactor 1 according to an embodiment of the present invention comprises a coil member 10, a core member 20 and a case 70.

Figure 5:
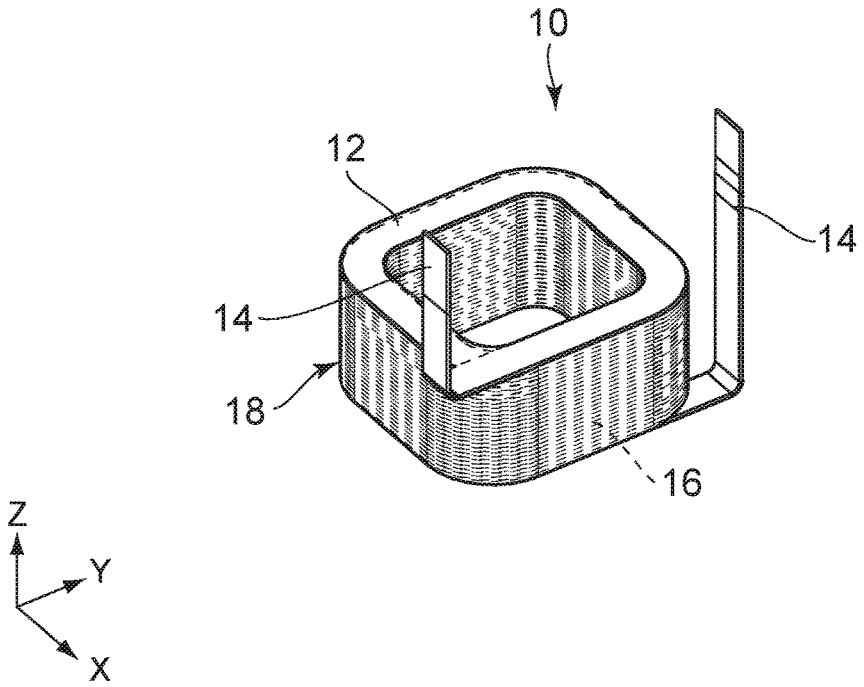
FIG. 5 is a perspective view showing a coil member of the reactor of FIG. 1.

As shown in FIG. 5, the coil member 10 according to the present embodiment is an insulation-coated conductive wire 16 which is wound and dipped to be formed with an insulation coating 18. In other words, the coil member 10 of the present embodiment comprises the insulation-coated conductive wire 16 and the insulation coating 18. The insulation-coated conductive wire 16 is wound and further coated, at least in part, with the insulation coating 18. The insulation-coated conductive wire 16 of the present embodiment includes a flat wire which is wound edgewise.

In detail, the coil member 10 comprises a coil body 12 and two end portions 14. The coil body 12 is wound around a winding axis extending along an upper-lower direction. The end portions 14 extend from opposite ends of the coil body 12, respectively. In the present embodiment, the upper-lower direction is the Z-direction, "upward" means the positive Z-direction, and "downward" means the negative Z-direction. According to the present embodiment, when the insulation-coated conductive wire 16 is dipped, the coil body 12 thereof is entirely dipped into a resin bath under a state where the end portions 14 thereof is held out of the resin bath. Therefore, the aforementioned insulation coating 18 coats the whole of the coil body 12 and a part of each of the end portions 14 which is near to the coil body 12.

The insulation coating 18 of the present embodiment is made of silicone and has an elastic modulus of 0.5 GPa or less.

The coil body 12 is looped around the winding axis. In detail, the coil body 12 of the present embodiment is helically looped and has a rectangular shape with rounded corners in a horizontal plane perpendicular to the upper-lower direction. In the present embodiment, the horizontal plane is the XY-plane. Moreover, the coil member 10 of the present embodiment has the single coil body 12. In the present embodiment, each of the end portions 14 works as a terminal of the coil member 10. However, the coil member 10 can be variously modified. For example, the coil body 12 may have a spiral shape or a combined shape of a helical shape and a spiral shape. In the horizontal plane, the coil body 12 may have a shape other than the rectangular shape with rounded corners. For example, the coil body 12 may have a circular shape in the horizontal plane. Moreover, the coil member 10 may be formed of coupled two coil bodies 12 to have an eye-glass shape in the horizontal plane. In each of the two coil bodies 12 of the eye-glass shape, only one of the end portions 14 may work as a terminal while the other end portion 14 may work as a connection portion which is connected to one of the end portions 14 of the other coil body 12.

As shown in FIGS. 2 and 3, the coil body 12 is embedded in the core member 20. Each of the end portions 14 extends upward beyond the upper surface of the core member 20. As can be seen from FIGS. 2, 3 and 5, the core member 20 and the coil body 12 of the coil member 10 form two magnetic circuits which are arranged in a lateral direction perpendicular to the upper-lower direction. In the present embodiment, the lateral direction is the Y-direction. Referring to FIG. 2, one of the magnetic circuits is formed of the left part of the core member 20, which is located about the left cross-section of the coil body 12, and a remaining one of the magnetic circuits is formed of the right part of the core member 20, which is located about the right cross-section of the coil body 12.

Figure 4:
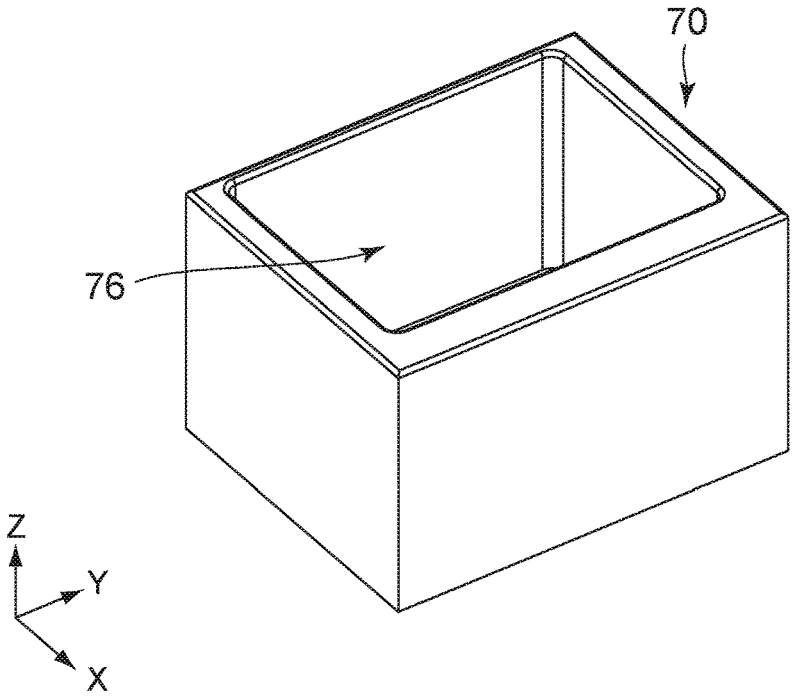
FIG. 4 is a perspective view showing a case of the reactor of FIG. 1.

As shown in FIG. 4, the case 70 opens upward and has an accommodation portion 76. As can be seen from FIGS. 2 to 4, the coil body 12 and the core member 20 of the coil member 10 is accommodated in the accommodation portion 76 of the case 70.

Figure 6:
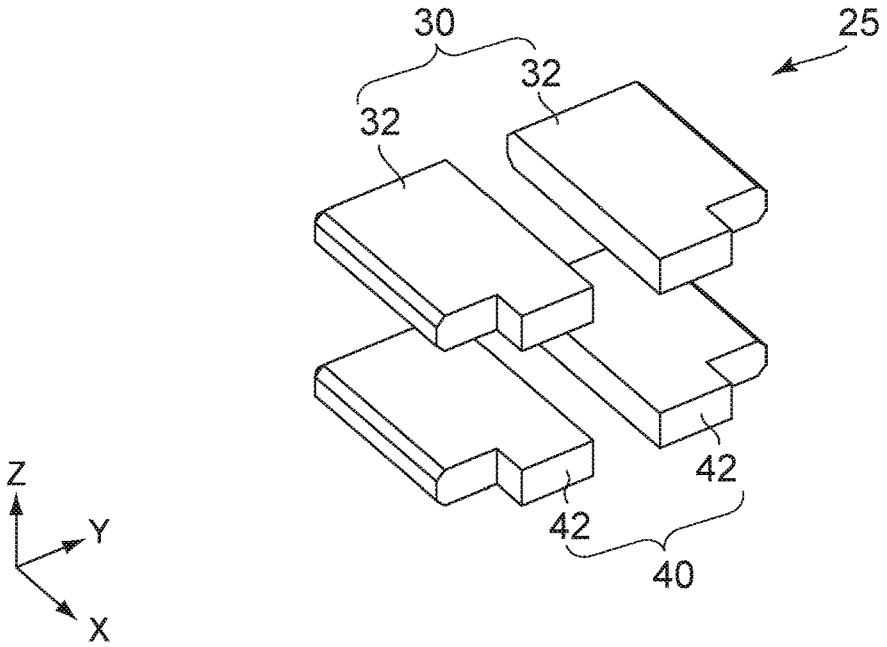
FIG. 6 is a perspective view showing an upper member and a lower member of a first member of the reactor of FIG. 1.

As shown in FIGS. 2, 3 and 6, the core member 20 comprises a first member 25 and a second member 50, and the first member 25 comprises an upper member 30 and a lower member 40.

Referring to FIG. 2, the second member 50 includes a composite magnet 60 and has a relative permeability between 1 and 30 (both inclusive). The composite magnet 60 is formed of a hardened binder 62 and magnetic particles 64 dispersed in the binder 62. As can be seen from FIGS. 2 and 5, the second member 50 of the present embodiment is arranged both inside an inner circumference 12*i* (see FIG. 8) of the coil body 12 and outside an outer circumference 12*o* (see FIG. 8) of the coil body 12. In addition, a part of the second member 50 of the present embodiment is arranged above and below the coil body 12. As shown in FIG. 2, according to the present embodiment, the binder 62 made of resin is mixed with the magnetic particles 64 and is subsequently kneaded to form a mixture, or a magnetic slurry. The magnetic slurry is hardened so that the composite magnet 60 is obtained. However, a forming method of the composite magnet 60 is not limited thereto. The composite magnet 60 may be formed by another method, provided that the resultant object, or the composite magnet 60, has the structure in which the magnetic particles 64 are dispersed within the hardened binder 62.

According to the present embodiment, the binder 62 is made of hardened epoxy resin, and the composite magnet 60 has an elastic modulus that is one hundred times or more than another elastic modulus of the insulation coating 18 which made of soft silicone. Since the insulation coating 18 is sufficiently flexible compared to the composite magnet 60, a deformation of the coil member 10 due to thermal expansion can be distributed into the insulation coating 18. Thus, the sufficiently flexible insulation coating 18 can suppress a bad influence which might be caused on the composite magnet 60 of the second member 50 because of the deformation of the coil member 10.

However, even in a case where the insulation coating 18 is made of soft material such as silicone, the insulation coating 18 might have insufficient elasticity when the insulation coating 18 is too thin. In other words, when the insulation coating 18 is thin, the insulation coating 18 might have a high effective elastic modulus, wherein the effective elastic modulus is a substantial elastic modulus in a thickness direction of a member which is compressed in the thickness direction. The effective elastic modulus is expressed by the formula of $Ee=F/A/\{(t0-t1)/t0\}/1000$, where Ee is the effective elastic modulus (GPa), F is a compressive force (N), A is a compressed area ($mm^2$), t0 is a thickness (mm) of the member before compression, and t1 is another thickness (mm) of the member after compression.

Figure 7:
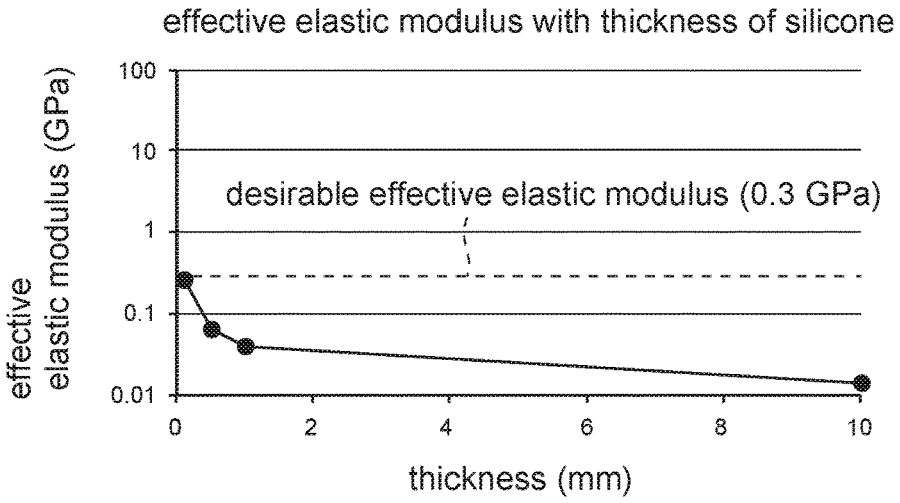
FIG. 7 is a graph showing relation between thickness and effective elastic modulus of a silicone material.

FIG. 7 shows the effective elastic modulus Ee of silicone calculated by the finite element method (FEM). The effective elastic modulus is desired to be 0.3 GPa or less in order for the insulation coating 18 to absorb the deformation of the coil member 10. As can be seen from FIG. 7, when the insulation coating 18 is made of silicone, the insulation coating 18 is desired to have a thickness of 0.1 mm or more.

The first member 25, or each of the upper member 30 and the lower member 40, has a relative permeability higher than another relative permeability of the second member 50. Referring to FIG. 6, the first member 25 of the present embodiment is a combination of dust cores each having a relative permeability of 50 or more.

In the present embodiment, the second member 50 has a linear expansion coefficient of X ppm, and the first member 25 has another linear expansion coefficient of Y ppm. The linear expansion coefficient (X) of the second member 50 and the linear expansion coefficient (Y) of the first member 25 satisfy a formula of $|X-Y| \leq 12$. As can be seen from this formula, the difference between the linear expansion coefficient of the first member 25 and the linear expansion coefficient of the second member 50 is designed to be small. This design reduces a stress applied to the first member 25 from the second member 50, and the first member 25 can be prevented from being damaged.

As shown in FIG. 1, the upper member 30 of the present embodiment is embedded in the second member 50. As shown in FIG. 2, the upper member 30 is located above the coil body 12. As shown in FIG. 6, the upper member 30 of the present embodiment is formed of a plurality of upper magnetic members 32. In the present embodiment, the number of the upper magnetic members 32 is two, and the upper magnetic members 32 are apart from each other in the lateral direction. As can be seen from FIG. 2, the upper magnetic members 32 are apart from each other in an area which has no influence on the two magnetic circuits. As shown in FIG. 6, the upper magnetic members 32 according to the present embodiment have shapes same as each other. In detail, each of the upper magnetic members 32 of the present embodiment has an L-like shape in the horizontal plane. As shown in FIG. 1, the upper magnetic members 32 are arranged in mirror symmetry with respect to a vertical plane which is perpendicular to the lateral direction and extends to include the midpoint between the upper magnetic members 32 in the lateral direction.

As shown in FIG. 6, the lower member 40 has a shape same as that of the upper member 30. As can be seen from FIGS. 2 and 6, the arrangement of the lower member 40 is same as that of the upper member 30 except that the lower member 40 is located below the coil body 12.

As shown in FIG. 6, the lower member 40 is formed of a plurality of lower magnetic members 42. In the present embodiment, the number of the lower magnetic members 42 is two, and the lower magnetic members 42 are apart from each other in the lateral direction. As can be seen from FIG. 6, the lower magnetic members 42 according to the present embodiment have shapes same as each other. Thus, the upper member 30 and the lower member 40 according to the present embodiment are formed of four magnetic members, namely the two upper magnetic members 32 and the two lower magnetic members 42, having shapes same as one another. The thus-shaped magnetic members (the two upper magnetic members 32 and the two lower magnetic members 42) can be made by using a single mold so that the manufacturing cost thereof can be reduced. The arrangement of the lower magnetic members 42 is similar to that of the upper magnetic members 32 illustrated in FIG. 1. More specifically, the lower magnetic members 42 are arranged in mirror symmetry with respect to a vertical plane which is perpendicular to the lateral direction and extends to include the midpoint between the lower magnetic members 42 in the lateral direction.

Figure 8:
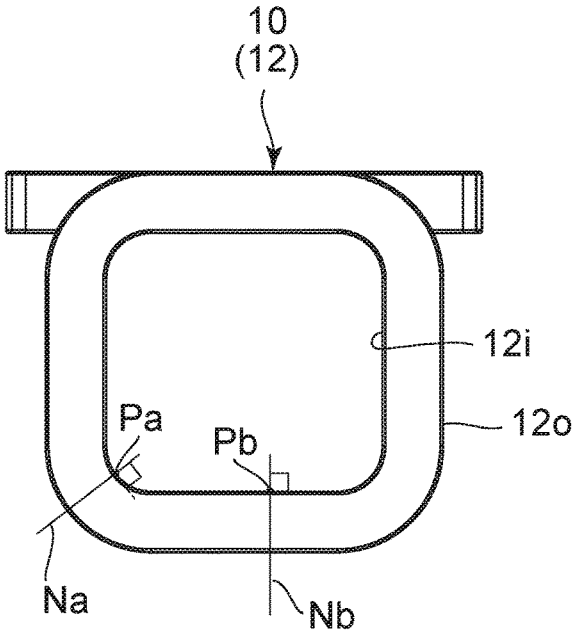
FIG. 8 is a view showing points, each of which is located on an inner circumference of a coil body of the coil member, and imaginary normal lines which correspond to the points, respectively.

Hereafter, explanation will be made about preferable positional relations between the coil body 12 and the first member 25 with reference to FIGS. 8 to 12, wherein the reference numerals "50 (60)" indicated in a blank area in each of FIGS. 9 to 12 means that the second member 50 made of the composite magnet 60 exists in the blank area. As shown in FIG. 8, when the coil body 12 is seen along the upper-lower direction, the inner circumference 12*i* of the coil body 12 has points at each of which a normal line is defined to extend along a normal direction. For example, a normal line Na is defined at a point Pa, and another normal line Nb is defined at another point Pb. The upper-lower direction (Z-direction) and the normal direction (N-direction) of each of the normal lines N (Na, Nb, etc.) define a predetermined plane, or the NZ-plane. As can be seen from FIGS. 9 to 12, the first member 25 and the coil body 12 embedded in the second member 50 have a specific relation therebetween in each of the NZ-planes.

Figure 9:
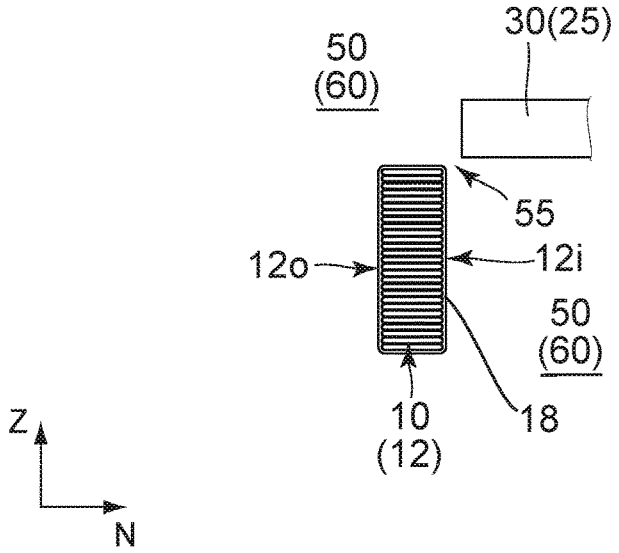
FIG. 9 is a view showing an unpreferable positional relation between the coil body and an upper member of the first member.

The second member 50 includes a deformable part which is in contact with a wide plane such as the inner circumference 12*i* and the outer circumference 12*o* of the coil body 12. Since the elastic modulus of the insulation coating 18 is one percent or less than the elastic modulus of the second member 50, the deformable part of the second member 50 is deformable to some extent along a direction perpendicular to the wide plane, or along the normal direction (N-direction) for the wide plane. In addition to the deformable part, the second member 50 includes a fixed part which is fixed to the boundary plane between the first member 25 and the second member 50. The fixed part of the second member 50 is hardly deformable. Thus, the boundary plane between the second member 50 and each of the inner circumference 12*i* and the outer circumference 12*o* of the coil body 12 is a deformable plane, while the boundary plane between the second member 50 and the first member 25 is a fixed plane. FIG. 9 shows an unpreferable positional relation between the first member 25 and the coil body 12. In this positional relation, the end of the first member 25 is located in the vicinity of one of the inner circumference 12*i* and the outer circumference 12*o* of the coil body 12 in the NZ-plane but is slightly apart from the coil body 12 along the N-direction. In other words, there is a narrow portion 55 formed between the coil body 12 and the first member 25 in the NZ-plane. According to this positional relation, the narrow portion 55 of the second member 50 might receive stress which is generated because of thermal expansion or thermal contraction of the coil member 10 and is concentrated to the narrow portion 55.

The second member 50 is preferred to be formed without the narrow portion 55 so that the aforementioned stress concentration can be reduced. More specifically, the coil body 12 and the first member 25 is preferred to be arranged in accordance with one of Positional Relations 1 to 3 (see FIGS. 10 to 12) described below. In each of FIGS. 10 to 12, only the upper member 30 of the first member 25 is illustrated. However, each of Positional Relations 1 to 3 is also applicable to the positional relation between the lower member 40 and the coil body 12.

(Positional Relation 1)

Figure 10:
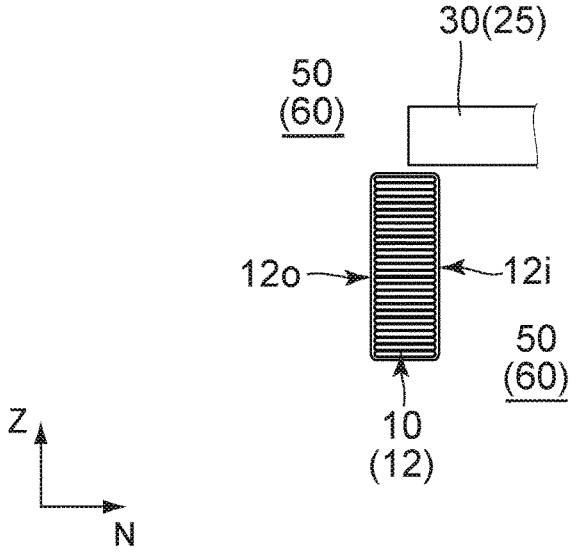
FIG. 10 is a view showing a preferable positional relation between the coil body and the upper member.

As shown in FIG. 10, in the NZ-plane, the upper member 30 of the first member 25 covers only the inner circumference 12*i* of the coil body 12 when seen along the upper-lower direction. The upper member 30 of the first member 25 may cover only the outer circumference 12*o* of the coil body 12 when seen along the upper-lower direction.

(Positional Relation 2)

Figure 11:
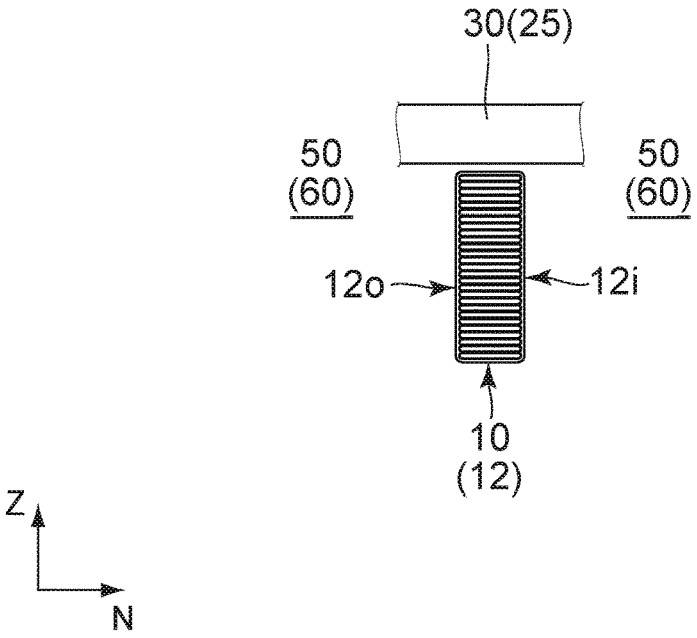
FIG. 11 is a view showing another preferable positional relation between the coil body and the upper member.

As shown in FIG. 11, in the NZ-plane, the upper member 30 of the first member 25 covers both the inner circumference 12*i* and the outer circumference 12*o* of the coil body 12 when seen along the upper-lower direction.

(Positional Relation 3)

Figure 12:
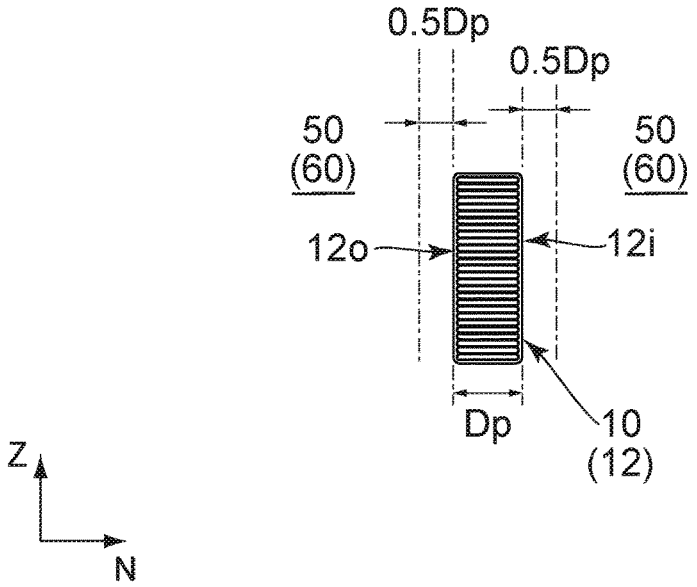
FIG. 12 is a view showing a positional relation between the coil body and the upper member, wherein the upper member is not located in the vicinity of the coil body.

As shown in FIG. 12, in the NZ-plane, the upper member 30 of the first member 25 does not cover any of the inner circumference 12*i* and the outer circumference 12*o* of the coil body 12 when seen along the upper-lower direction. In addition, the inner circumference 12*i* of the coil body 12 and the outer circumference 12*o* of the coil body 12 are apart from each other by a predetermined distance Dp in the normal direction (N-direction) for the inner circumference 12*i* or the outer circumference 12*o*, and the upper member 30 is apart from each of the inner circumference 12*i* and the outer circumference 12*o* in the normal direction (N-direction) by half or more than the predetermined distance Dp (i.e. equal to or more than 0.5 Dp). In other words, the first member 25 is not arranged between an outer location which is apart outward from the outer circumference 12*o* by the distance of 0.5 Dp and an inner location which is apart inward from the inner circumference 12*i* by the distance of 0.5 Dp. For example, the two upper magnetic members 32 according to Positional Relation 3 may be arranged in the area between the two upper magnetic members 32 shown in FIG. 2.

When one of the aforementioned Positional Relations 1 to 3 is satisfied with respect to every normal line at every point on the inner circumference 12*i* of the coil body 12, the narrow portion 55 as shown in FIG. 9 is not formed so that the stress concentration can be reduced.

While there has been described about the present invention as referring to the specific embodiment, the present invention is not limited thereto but can be variously modified.

In the aforementioned embodiment, each of the upper magnetic members 32 of the upper member 30 has an L-like shape. However, the present invention is not limited thereto. For example, the upper magnetic member 32 may have a simple shape such as a rectangle. This modification is applicable to the lower member 40.

In the aforementioned embodiment, the two upper magnetic members 32 are arranged to be apart from each other in the lateral direction. However, the present invention is not limited thereto. For example, a plurality of the magnetic members may be arranged to be apart from one another in a front-rear direction perpendicular to both the upper-lower direction and the lateral direction. In each of Figures referred in the aforementioned embodiment, the front-rear direction is the X-direction.

Figure 13:
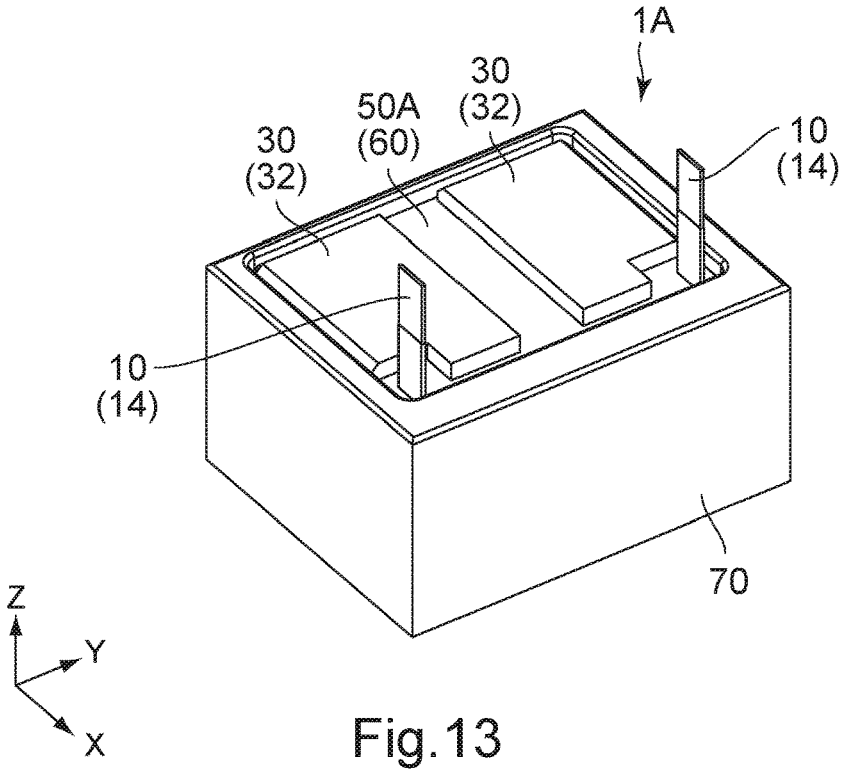
FIG. 13 is a perspective view showing a modification of the reactor of FIG. 1.

In the aforementioned embodiment, the upper member 30 is entirely embedded in the second member 50. However, the present invention is not limited thereto. For example, as shown in FIG. 13, a reactor 1A according to a modification may comprise the upper member 30 that is exposed from a second member 50A.

Figure 14:
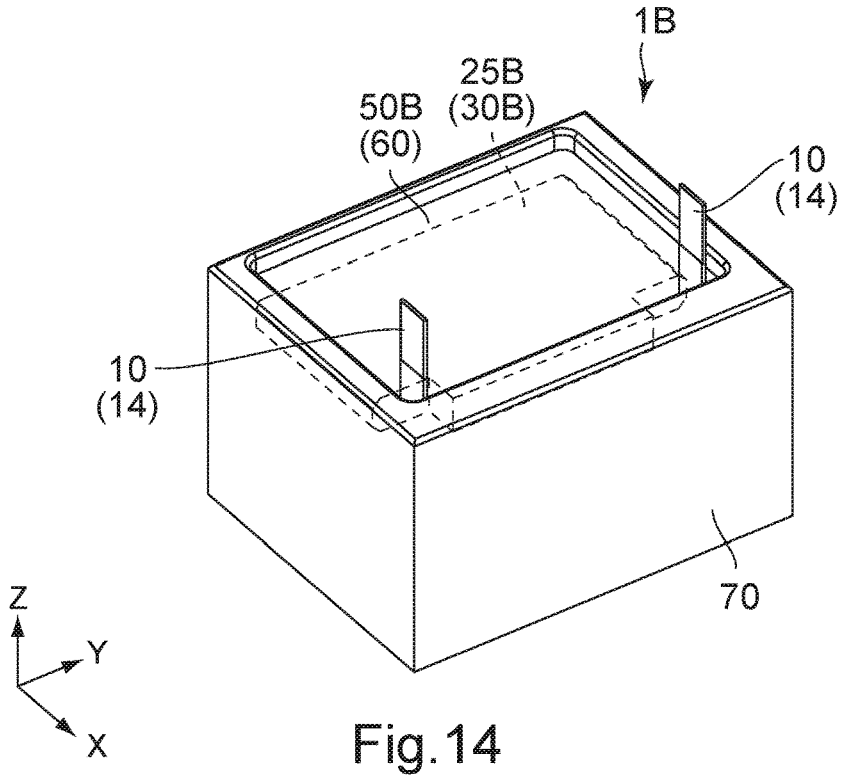
FIG. 14 is a perspective view showing another modification of the reactor of FIG. 1.

In the aforementioned embodiment, the upper member 30 is formed of the two upper magnetic members 32. However, the present invention is not limited thereto. For example, as shown in FIG. 14, a reactor 1B may comprise a first member 25B which comprises an upper member 30B formed of a single magnetic member. Although the illustrated upper member 30B is entirely embedded in a second member 50B, the upper member 30B may be partially exposed from the second member 50B. Similarly, the reactor 1B may comprise a lower member formed of a single magnetic member.

In the aforementioned embodiment, the second member 50 is formed of only the composite magnet 60. However, the present invention is not limited thereto. For example, the second member 50 may comprise a gap member made of nonmagnetic material in addition to the composite magnet 60.

In the aforementioned embodiment, the composite magnet 60 is the binder 62 made of resin and mixed with the magnetic particles 64 dispersed therewithin. However, the present invention is not limited thereto. For example, the composite magnet 60 may the binder 62 mixed with the magnetic particles 64 and nonmagnetic fillers dispersed therewithin.

The reactor according to the aforementioned present invention is particularly suitable for an in-vehicle reactor.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A reactor comprising a coil member and a core member, wherein:

the coil member comprises an insulation-coated conductive wire and an insulation coating;

the insulation-coated conductive wire is wound and coated, at least in part, with the insulation coating;

the core member comprises a first member and a second member;

the first member has a relative permeability that is higher than another relative permeability of the second member;

the second member includes a composite magnet, and the relative permeability of the second member is between 1 and 30, both inclusive;

the composite magnet is formed of a hardened binder and magnetic particles dispersed in the binder;

the composite magnet has an elastic modulus that is one hundred times or more another elastic modulus of the insulation coating; and the insulation coating has an effective elastic modulus of 0.3 GPa or less, wherein the effective elastic modulus is a substantial elastic modulus in a thickness direction of a member which is compressed in the thickness direction.

2. The reactor as recited in claim 1, wherein the insulation coating has a thickness of 0.1 mm or more.

3. The reactor as recited in claim 1, wherein:

the second member has a linear expansion coefficient of X ppm;

the first member has another linear expansion coefficient of Y ppm; and the linear expansion coefficient of the second member and the linear expansion coefficient of the first member satisfy $|X-Y| \leq 12$.

4. A reactor comprising a coil member and a core member, wherein:

the coil member comprises an insulation-coated conductive wire and an insulation coating;

the insulation-coated conductive wire is wound and coated, at least in part, with the insulation coating;

the core member comprises a first member and a second member;

the first member has a relative permeability that is higher than another relative permeability of the second member;

the second member includes a composite magnet, and the relative permeability of the second member is between 1 and 30, both inclusive;

the composite magnet is formed of a hardened binder and magnetic particles dispersed in the binder;

the composite magnet has an elastic modulus that is one hundred times or more another elastic modulus of the insulation coating;

the coil member comprises a coil body and two end portions;

the coil body is wound around an axis extending along an upper-lower direction;

the end portions extend from opposite ends of the coil body, respectively;

the first member comprises an upper member and a lower member;

the upper member is located above the coil body;

the lower member is located below the coil body;

the second member is arranged both inside an inner circumference of the coil body and outside an outer circumference of the coil body;

the inner circumference of the coil body has points at each of which a normal line is defined to extend along a normal direction;

the upper-lower direction and the normal direction of each of the normal lines define a predetermined plane;

in each of the predetermined planes, the inner circumference of the coil body and the outer circumference of the coil body are apart from each other by a predetermined distance in the normal direction;

in each of the predetermined planes, the upper member covers at least one of the inner circumference and the outer circumference when seen along the upper-lower direction, or is apart from each of the inner circumference and the outer circumference in the normal direction by half or more than the predetermined distance; and in each of the predetermined planes, the lower member covers at least one of the inner circumference and the outer circumference when seen along the upper-lower direction, or is apart from each of the inner circumference and the outer circumference in the normal direction by half or more than the predetermined distance.

* * * * *